US009647369B2

(12) United States Patent
Tsai et al.

(10) Patent No.: US 9,647,369 B2
(45) Date of Patent: May 9, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long-Fei Chen, New Taipei (TW); Dong Xiang, New Taipei (TW); Da-Wei Zhu, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/274,588

(22) Filed: Sep. 23, 2016

(65) Prior Publication Data

US 2017/0085021 A1 Mar. 23, 2017

(30) Foreign Application Priority Data

Sep. 23, 2015 (CN) ..... 2015 1 0608864

(51) Int. Cl.

| | |
|---|---|
| ***H01R 13/405*** | (2006.01) |
| ***H01R 12/71*** | (2011.01) |
| ***H01R 24/62*** | (2011.01) |
| ***H01R 4/02*** | (2006.01) |
| ***H01R 13/6581*** | (2011.01) |
| *H01R 107/00* | (2006.01) |

(52) U.S. Cl.

CPC ..... *H01R 13/405* (2013.01); *H01R 4/02* (2013.01); *H01R 12/716* (2013.01); *H01R 13/6581* (2013.01); *H01R 24/62* (2013.01); *H01R 2107/00* (2013.01)

(58) Field of Classification Search

CPC ..... H01R 24/60

See application file for complete search history.

(56) References Cited

U.S. PATENT DOCUMENTS

| | | | | |
|---|---|---|---|---|
| 9,209,573 | B1 * | 12/2015 | Chen | H01R 13/6581 |
| 9,281,642 | B1 * | 3/2016 | Tseng | H01R 24/60 |
| 9,281,643 | B1 * | 3/2016 | Tseng | H01R 13/518 |
| 9,306,337 | B2 * | 4/2016 | Yu | H01R 24/60 |
| 9,312,644 | B2 * | 4/2016 | Kao | H01R 13/6591 |
| 9,318,856 | B2 * | 4/2016 | MacDougall | H01R 13/6581 |
| 9,337,588 | B2 * | 5/2016 | Chang | H01R 13/6594 |
| 9,350,121 | B2 * | 5/2016 | Ju | H01R 13/6585 |
| 9,356,406 | B2 * | 5/2016 | Yen | H01R 13/6585 |
| 9,425,559 | B2 * | 8/2016 | Kao | H01R 13/6585 |
| 9,425,560 | B1 * | 8/2016 | Su | H01R 13/506 |

(Continued)

*Primary Examiner* — Ross Gushi

(74) *Attorney, Agent, or Firm* — Muncy, Geissler, Olds & Lowe, P.C.

(57) ABSTRACT

An electrical receptacle connector includes a first insulated member and a second insulated member that are received in a metallic shell. A plurality of first receptacle terminals and a plurality of second receptacle terminals are respectively held in the first insulated member and the second insulated member. The first insulated member includes a tongue portion. The second insulated member includes a terminal positioning portion on the surface of the first insulated member. The surface of the terminal positioning portion and the surface of the tongue portion are at the same horizontal plane. A surface texture of the terminal positioning portion is different from a surface texture of the tongue portion.

19 Claims, 13 Drawing Sheets

(56) References Cited

U.S. PATENT DOCUMENTS 9,444,177 B2 * 9/2016 Tsai ..... H01R 13/5202
9,444,200 B2 * 9/2016 Yen ..... H01R 24/60
9,461,412 B2 * 10/2016 Yu ..... H01R 13/6585
9,461,413 B2 * 10/2016 Duan ..... H01R 13/6594
9,461,415 B2 * 10/2016 Guo ..... H01R 13/41
9,461,424 B2 * 10/2016 Kao ..... H01R 24/60
9,466,930 B2 * 10/2016 Little ..... H01R 24/60
9,472,902 B2 * 10/2016 Kao ..... H01R 13/6471
9,472,911 B2 * 10/2016 Little ..... H01R 24/60
9,478,915 B2 * 10/2016 Guo ..... H01R 13/6585
9,484,662 B2 * 11/2016 Guo ..... H01R 13/504
9,484,675 B2 * 11/2016 Chen ..... H01R 12/57
9,484,677 B2 * 11/2016 Guo ..... H01R 13/6585
9,484,679 B2 * 11/2016 Guo ..... H01R 13/6585
9,490,579 B2 * 11/2016 Little ..... H01R 13/642
9,490,594 B2 * 11/2016 Little ..... H01R 24/60
9,490,595 B2 * 11/2016 Little ..... H01R 13/6594
9,496,653 B2 * 11/2016 Little ..... H01R 13/6582
9,496,664 B2 * 11/2016 Little ..... H01R 13/6587
9,502,821 B2 * 11/2016 Little ..... H01R 13/6582
9,502,839 B2 * 11/2016 Tsai ..... H01R 12/724
9,502,840 B2 * 11/2016 Kao ..... H01R 13/6581
9,515,405 B2 * 12/2016 Zhao ..... H01R 13/405
9,525,236 B2 * 12/2016 Lee ..... H01R 13/5202
9,525,241 B1 * 12/2016 Su ..... H01R 13/6581
9,525,243 B1 * 12/2016 Yuan ..... H01R 13/6585
9,525,244 B1 * 12/2016 Hsu ..... H01R 13/6585
9,525,251 B2 * 12/2016 Yen ..... H01R 24/60
9,548,571 B2 * 1/2017 Deng ..... H01R 13/6581
9,553,410 B2 * 1/2017 Zhao ..... H01R 13/6581
9,564,716 B2 * 2/2017 Kao ..... H01R 13/6586
9,577,387 B2 * 2/2017 Hu ..... H01R 13/6597
2015/0194768 A1 * 7/2015 Little ..... H01R 13/6594
439/607.37
2015/0200504 A1 * 7/2015 Little ..... H01R 24/60
439/345
2015/0207280 A1 * 7/2015 Little ..... H01R 24/60
439/607.34
2015/0229077 A1 * 8/2015 Little ..... H01R 13/6582
439/78
2015/0244111 A1 * 8/2015 Ju ..... H01R 13/6585
439/607.05
2015/0255905 A1 * 9/2015 Little ..... H01R 13/6658
439/78
2015/0270646 A1 * 9/2015 Kao ..... H01R 13/6581
439/76.1
2015/0270661 A1 * 9/2015 Kao ..... H01R 13/5202
439/271
2015/0333451 A1 * 11/2015 Kao ..... H01R 24/60
439/607.01
2015/0340791 A1 * 11/2015 Kao ..... H01R 24/60
439/676
2015/0380868 A1 * 12/2015 Chen ..... H01R 13/6585
439/607.01
2016/0013592 A1 * 1/2016 Kao ..... H01R 13/6471
439/607.55
2016/0013593 A1 * 1/2016 Kao ..... H01R 13/6585
439/607.01
2016/0020560 A1 * 1/2016 Ju ..... H01R 24/78
439/607.05
2016/0020572 A1 * 1/2016 Ju ..... H01R 24/78
264/272.14
2016/0028190 A1 * 1/2016 Chen ..... H01R 12/57
439/607.01
2016/0043511 A1 * 2/2016 Hsu ..... H01R 13/6585
439/607.05
2016/0064866 A1 * 3/2016 Kao ..... H01R 13/6596
439/676
2016/0064869 A1 * 3/2016 Yu ..... H01R 24/60
439/607.05
2016/0099526 A1 * 4/2016 Chen ..... H01R 13/5045
439/607.05
2016/0104957 A1 * 4/2016 Kim ..... H01R 13/6581
439/78
2016/0104975 A1 * 4/2016 Guo ..... H01R 13/6585
439/607.05
2016/0104976 A1 * 4/2016 Yu ..... H01R 13/6585
439/607.05
2016/0118750 A1 * 4/2016 Guo ..... H01R 13/6585
439/78
2016/0118752 A1 * 4/2016 Guo ..... H01R 13/6585
439/78
2016/0126677 A1 * 5/2016 Yu ..... H01R 13/6474
439/607.23
2016/0141792 A1 * 5/2016 Zhao ..... H01R 13/6581
439/78
2016/0141805 A1 * 5/2016 Zhao ..... H01R 13/504
439/607.01
2016/0141806 A1 * 5/2016 Guo ..... H01R 13/504
439/607.01
2016/0149349 A1 * 5/2016 Kao ..... H01R 13/6586
439/607.05
2016/0149350 A1 * 5/2016 Kao ..... H01R 24/60
439/607.05
2016/0181722 A1 * 6/2016 Tsai ..... H01R 13/5202
439/587
2016/0197443 A1 * 7/2016 Zhang ..... H01R 13/6585
439/607.05
2016/0233606 A1 * 8/2016 Zhao ..... H01R 13/5202
2016/0233630 A1 * 8/2016 Cheng ..... H01R 24/60
2016/0233631 A1 * 8/2016 Yen ..... H01R 13/6581
2016/0240977 A1 * 8/2016 Yu ..... H01R 13/6471
2016/0240980 A1 * 8/2016 Yu ..... H01R 13/6581
2016/0261056 A1 * 9/2016 Jiang ..... H01R 13/6585
2016/0294102 A1 * 10/2016 Zhao ..... H01R 13/6581
2016/0294108 A1 * 10/2016 Tsai ..... H01R 13/5219
2016/0294130 A1 * 10/2016 Guo ..... H01R 24/60
2016/0315422 A1 * 10/2016 Cheng ..... H01R 13/6581
2016/0315424 A1 * 10/2016 Tsai ..... H01R 13/6581
2016/0322759 A1 * 11/2016 Park ..... H01R 13/6585
2016/0329645 A1 * 11/2016 Tsai ..... H01R 13/6585
2016/0329646 A1 * 11/2016 Tsai ..... H01R 12/75
2016/0329663 A1 * 11/2016 Han ..... H01R 13/6593
2016/0329667 A1 * 11/2016 Tsai ..... H01R 24/70
2016/0344142 A1 * 11/2016 Zhao ..... H01R 13/6594
2016/0352041 A1 * 12/2016 Yao ..... H01R 13/405
2016/0352051 A1 * 12/2016 Tsai ..... H01R 13/6585
2016/0352052 A1 * 12/2016 Yu ..... H01R 13/6594
2016/0359256 A1 * 12/2016 Zhang ..... H01R 13/405
2016/0372850 A1 * 12/2016 Tsai ..... H01R 12/724
2016/0372870 A1 * 12/2016 Guo ..... H01R 24/60
2016/0380388 A1 * 12/2016 Guo ..... H01R 13/6581
439/83
2016/0380389 A1 * 12/2016 Ju ..... H01R 13/6585
439/607.05
2017/0018883 A1 * 1/2017 Chen ..... H01R 24/62
2017/0033507 A1 * 2/2017 Tsai ..... H01R 13/6585
2017/0040721 A1 * 2/2017 Tsai ..... H01R 12/57
2017/0040724 A1 * 2/2017 Little ..... H01R 12/724
2017/0040730 A1 * 2/2017 Yu ..... H01R 13/405
2017/0040747 A1 * 2/2017 Hayashi ..... H01R 24/60
2017/0040748 A1 * 2/2017 Tsai ..... H01R 13/6585
2017/0040750 A1 * 2/2017 Little ..... H01R 13/6587
2017/0047674 A1 * 2/2017 Tsai ..... H01R 12/716
2017/0047687 A1 * 2/2017 Yao ..... H01R 13/6471
2017/0047689 A1 * 2/2017 Yao ..... H01R 13/652
2017/0047693 A1 * 2/2017 Little ..... H01R 13/6587
2017/0054246 A1 * 2/2017 Yao ..... H01R 13/521
2017/0054258 A1 * 2/2017 Little ..... H01R 24/60

* cited by examiner

100

| | | | | | | | | | | | | | | | | |
|---|---|---|---|---|---|---|---|---|---|---|---|---|---|---|---|---|
| GND | TX1+ | TX1− | VBUS | CC1 | D+ | D− | SBU1 | VBUS | RX2− | RX2+ | GND | 31 |
| GND | RX1+ | RX1− | VBUS | SBU2 | D− | D+ | CC2 | VBUS | TX2− | TX2+ | GND | 41 |

Fig. 8

ELECTRICAL RECEPTACLE CONNECTOR

CROSS-REFERENCE TO RELATED APPLICATION

This non-provisional application claims priority under 35 US. §119(a) to Patent Application No. 201510608864.6 filed in China, PC. In Sep. 23, 2015, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (US) is a serial bus standard to the PC architecture with a focus on computer interface, consumer and productivity applications. The existing Universal Serial Bus (US) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of US 2.0 is insufficient. As a consequence, faster serial bus interfaces such as US 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional US type-C electrical connector are totally different from those of a conventional US electrical connector. A conventional US type-C electrical receptacle connector includes a plastic core, upper and lower receptacle terminals held on the plastic core, and an outer iron shell circularly enclosing the plastic core. Normally, the plastic core of a conventional US type-C electrical receptacle connector is an assembly of several plastic components, and the upper receptacle terminals and the lower receptacle terminals are respectively assembled with the plastic components.

SUMMARY OF THE INVENTION

The plastic components are combined with each other merely by assembling means; once the plastic components cannot fitted with each other properly, the structural strength of the assembly is reduced and some of the plastic components may even detach off the assembly. Moreover, because contact portions of the receptacle terminals are not positioned by a tongue portion of the connector, the receptacle terminals may be detached from the plastic core during the operation. Therefore, how to solve the aforementioned problem is an issue.

In view of this, an embodiment of the instant disclosure provides an electrical receptacle connector. The electrical receptacle connector comprises a second terminal module, a plurality of first receptacle terminals, and a metallic shell. The second terminal module comprises a plurality of second receptacle terminals and a second insulated member integrally formed with the second receptacle terminals. Each of the second receptacle terminals comprises a second flat contact portion. The second insulated member has a terminal positioning portion positioned with the second flat contact portions. The terminal positioning portion comprises a disposing surface. Front ends of the second flat contact portions are held in the disposing surface. The first receptacle terminals are on the second terminal module. The first receptacle terminals are integrally formed with a first insulated member to form a first terminal module. The first insulated member comprises a tongue portion. One of two opposite surfaces of the tongue portion comprises an assembling surface, and the other surface of the tongue portion comprises a specific portion opposite to the assembling surface. First flat contact portions of the first receptacle terminals are positioned with the assembling surface, and front ends of the first flat contact portions are held in the assembling surface. The terminal positioning portion is held in the tongue portion. The disposing surface of the terminal positioning portion and the specific portion of the tongue portion are at a same plane, and a surface texture of the terminal positioning portion is different from a surface texture of the specific portion. The metallic shell comprises a receptacle cavity for receiving the first terminal module and the second terminal module.

In one embodiment, the first receptacle terminals are positioned by a positioning block, so that positions of the first receptacle terminals and distances between adjacent first receptacle terminals are fixed. The positioning block is enclosed by the first insulated member.

In one embodiment, each of the first receptacle terminals comprises a first engaging portion extending from a front portion of the corresponding first flat contact portion and engaged into the tongue portion.

In one embodiment, each of the second receptacle terminals comprises a second engaging portion extending from a front portion of the corresponding second flat contact portion and engaged into the terminal positioning portion.

In one embodiment, the first insulated member comprises a first base, and the tongue portion is extending from one end of the first base. The second insulated member comprises a second base, and the terminal positioning portion is extending from one end of the second base. The first base is integrally formed on the second base. Moreover, a surface texture of the first base is different from a surface texture of the second base. In addition, each of the first receptacle terminals further comprises a first tail portion extending, from the corresponding first flat contact portion, out of a bottom of the first base, and each of the second receptacle terminals further comprises a second tail portion extending from the second flat contact portion, out of a bottom of the second base. The first tail portions are aligned with the second tail portions by an offset. Additionally, the first insulated member comprises a thicken block near to the first base and the second base, and the thicken block covers a portion between the terminal positioning portion and the second base.

In one embodiment, the electrical receptacle connector further comprises a first conductive sheet and a second conductive sheet respectively on the first insulated member and the second insulated member. Furthermore, the first conductive sheet has two first contact legs at two sides thereof. The two first contact legs pass through two first through holes of the first insulated member and are in contact with two first ground terminals which are at two sides of the first receptacle terminals, respectively. Likewise, the second conductive sheet has two second contact legs at two sides thereof. The two second contact legs pass through two second through holes of the second insulated member and are in contact with two second ground terminals which are at two sides of the second receptacle terminals, respectively.

In one embodiment, the specific portion of the tongue portion comprises a separating portion formed around a periphery of the terminal positioning portion.

In one embodiment, the electrical receptacle connector further comprises a shielding plate integrally formed with the second insulated member and between the first receptacle terminals and the second receptacle terminals.

Another embodiment of the electrical receptacle connector comprises a base portion, a plurality of first receptacle terminals, a plurality of second receptacle terminals, a shielding plate, and a metallic shell. One end of the base portion extends a tongue portion to form an insulated housing. One of two opposite surfaces of the tongue portion comprises an assembling surface, and the other surface of the tongue portion comprises a specific portion opposite to the assembling surface. The specific portion comprises a terminal positioning portion. A surface texture of the terminal positioning portion is different from a surface texture of the specific portion. Each of the first receptacle terminals comprises a first flat contact portion and a first tail portion extending from the first flat contact portion. The first flat contact portions are formed and positioned with the assembling surface, front ends of the first flat contact portions are held in the assembling surface, and the first tail portions are formed with the base portion. Each of the second receptacle terminals comprises a second flat contact portion and a second tail portion extending from the second flat contact portion. The second flat contact portions are formed and positioned with the terminal positioning portion, front ends of the second flat contact portions are held in the terminal positioning portion, and the second tail portions are formed with the base portion. The shielding plate is in the base portion and the tongue portion. The shielding plate is between the first receptacle terminals and the second receptacle terminals. The metallic shell comprises a receptacle cavity for receiving the base portion and the tongue portion.

Based on the above, after the second insulated member is formed, the first receptacle terminals are disposed on the second insulated member. Next, the terminal positioning portion is assembled with the second insulated member by molding or glue pouring. The terminal positioning portion is further positioned with the first receptacle terminals. Therefore, the first insulated member and the second insulated member are integrally formed with each other. Accordingly, the first receptacle terminals, the second receptacle terminals, the first insulated member, and the second insulated member are firmly positioned with each other. Hence, when the connector is impacted by a foreign force, the components of the connector would not detach from each other easily. Moreover, after the assembling procedure, the surface of the terminal positioning portion and the surface of the tongue portion are different in texture for indicating different forming procedures. Additionally, the first and the second engaging portions of the first and the second receptacle terminals are engaged into the tongue portion and the terminal positioning portion, respectively. Accordingly, the flat contact portions of the electrical receptacle connector would not detach off the tongue portion and the terminal positioning portion after the connector is used for a period.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. An either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 8 illustrates a schematic configuration diagram of the receptacle terminals of the electrical receptacle connector;

DETAILED DESCRIPTION

Figure 1:
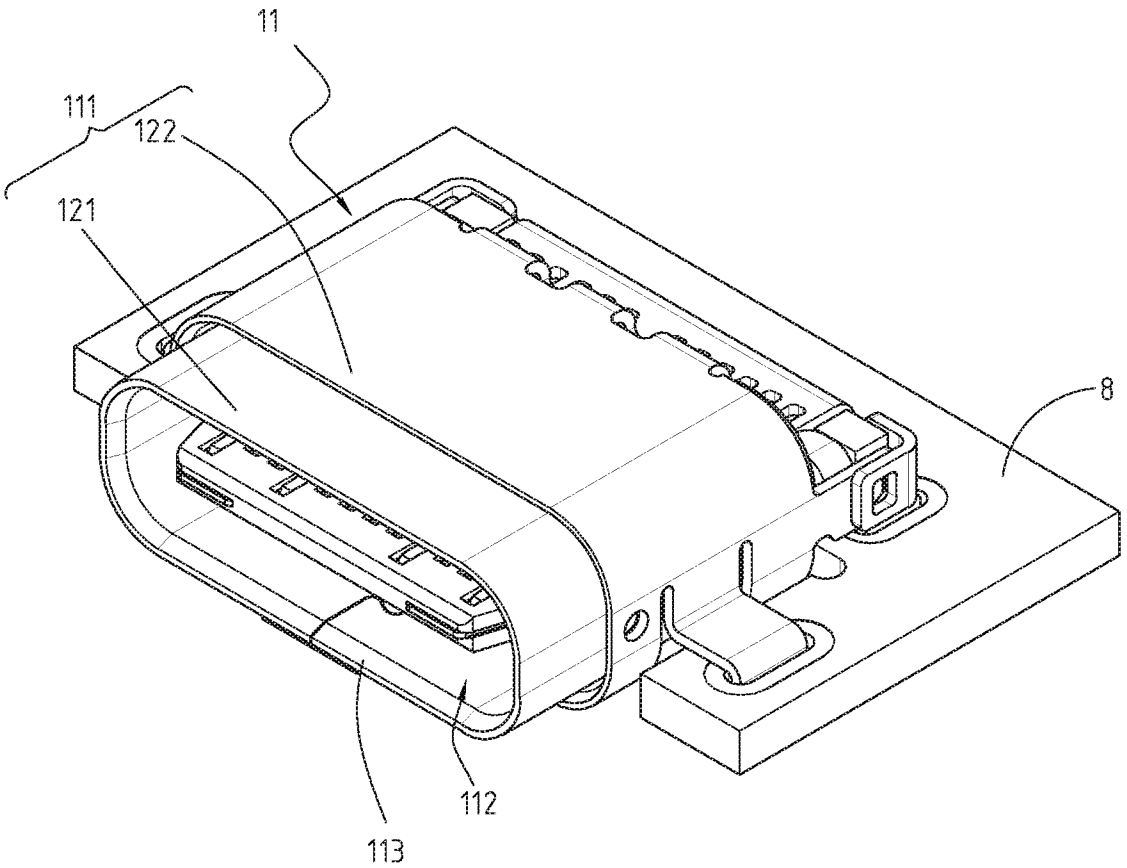
FIG. 1 illustrates a perspective view of an electrical receptacle connector according to a first embodiment of the instant disclosure.
Figure 2:
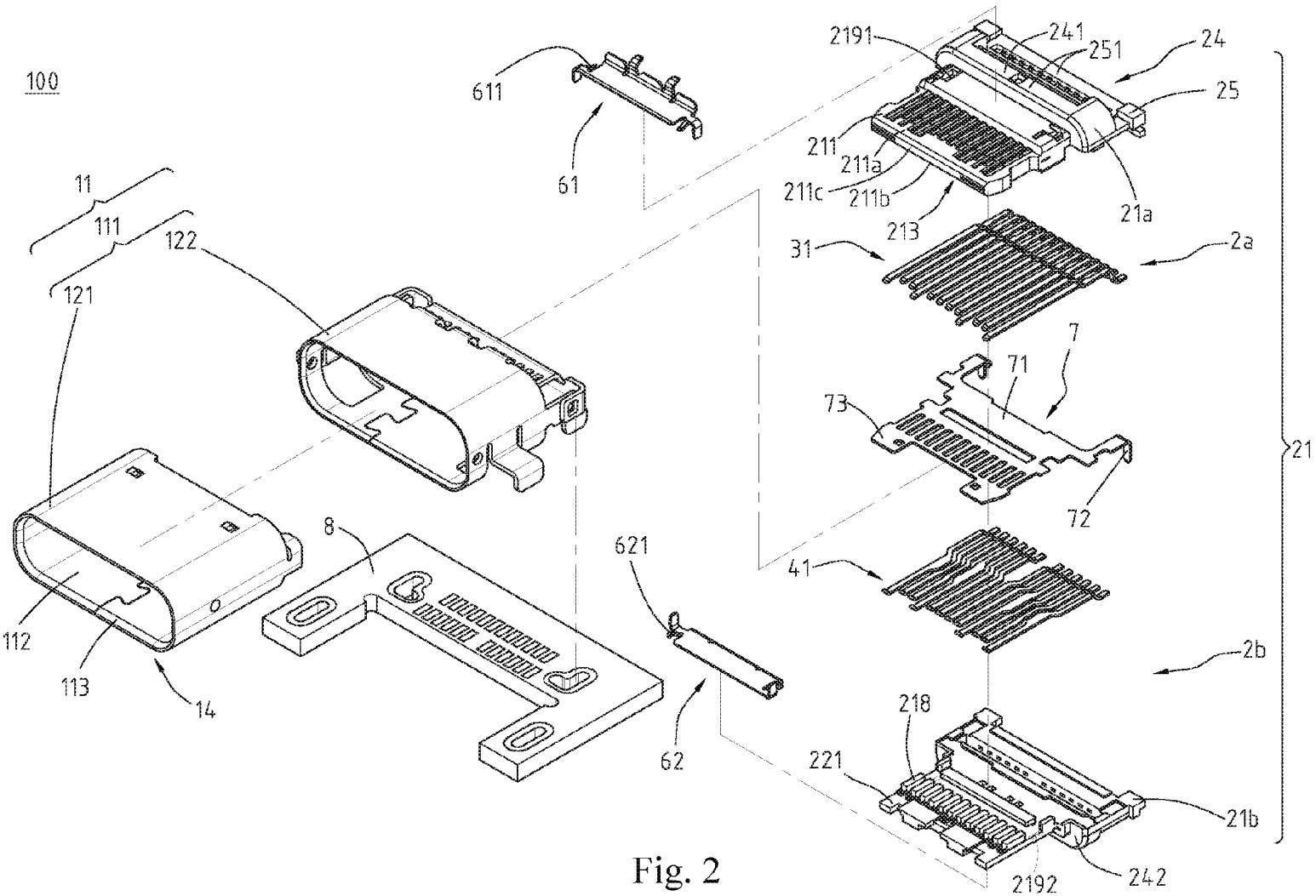
FIG. 2 illustrates an exploded view of the electrical receptacle connector of the first embodiment.

Please refer to FIGS. 1 and 2, illustrating an electrical receptacle connector 100 of an exemplary embodiment of the instant disclosure. FIG. 1 illustrates a perspective view of an electrical receptacle connector according to a first embodiment of the instant disclosure. FIG. 2 illustrates an exploded view of the electrical receptacle connector. In this embodiment, the electrical receptacle connector 100 is assembled with a circuit board 8 by sinking technique. That is, one side of the circuit board 8 is cut to form a crack, and the electrical receptacle connector 100 is positioned at the crack and extending toward the side portion of the circuit board 8. In this embodiment, the electrical receptacle connector 100 can provide a reversible or dual orientation US Type-C connector interface and pin assignments, i.e., a US Type-C receptacle connector. In this embodiment, the electrical receptacle connector 100 comprises a metallic shell 11, a first terminal module 2*a*, and a second terminal module 2*b*.

Please refer to FIGS. 1 and 2. In this embodiment, the metallic shell 11 is a hollowed shell, and the metallic shell 11 comprises a shell body 111 and a receptacle cavity 112 formed in the shell body 111. In other words, the metallic shell 11 comprises a receptacle cavity 112 for receiving the first terminal module 2*a* and the second terminal module 2*b*. In this embodiment, the metallic shell 11 may be a tubular member 14 and the receptacle cavity 112 is formed in the tubular member 14. The metallic shell 11 may be formed by a multi-piece member; in such embodiment, the metallic shell 11 comprises an inner shell 121 and a cover plate 122, wherein the inner shell 121 is a hollowed shell and encloses the insulated housing 21, and the cover plate 122 is a hollowed shell and encloses the inner shell 121, but embodiments are not limited thereto. In some embodiments, the cover plate 122 may be a semi-tubular member having a U-shape cross section, and the semi-tubular member covers the top and the two sides of the inner shell 121. In addition, an insertion opening 113 with oblong shaped is formed on one side of the metallic shell 11, and the insertion opening 113 communicates with the receptacle cavity 112.

Please refer to FIGS. 1 and 2. In this embodiment, the insulated housing 21 comprises a base portion 24 and a tongue portion 211 extending from one end of the base portion 24. In this embodiment, the insulated housing 21 comprises a first insulated member 21*a* and a second insulated member 21*b* integrally formed with each other. The base portion 24 comprises a first base 241 and a second base 242. The first base 241 is adjacent to the first insulated member 21*a*. The second base 242 is adjacent to the second insulated member 21*b*.

Figure 3:
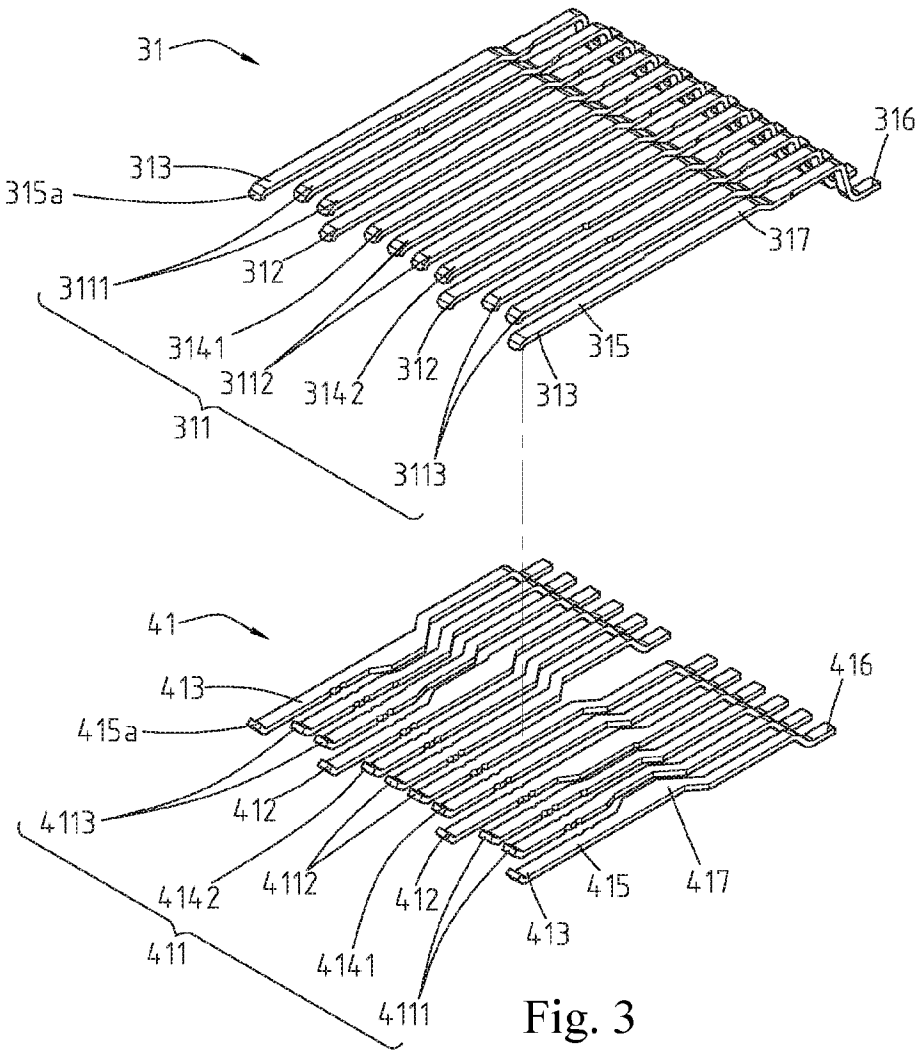
FIG. 3 illustrates an exploded view of receptacle terminals of the electrical receptacle connector.
Figure 7:
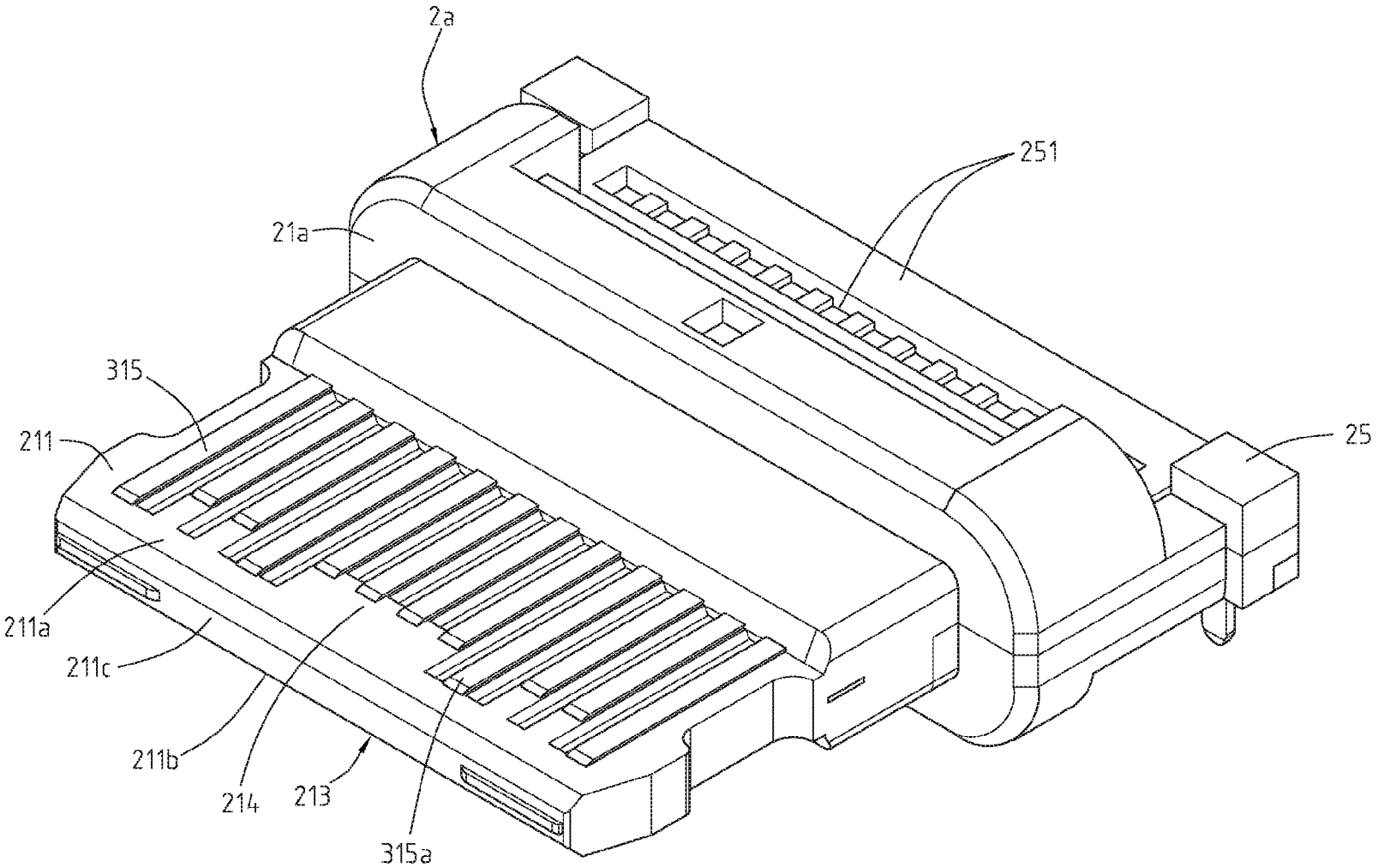
FIG. 7 illustrates a schematic view (4) showing an assembling procedure of the electrical receptacle connector of the first embodiment.
Figure 9:
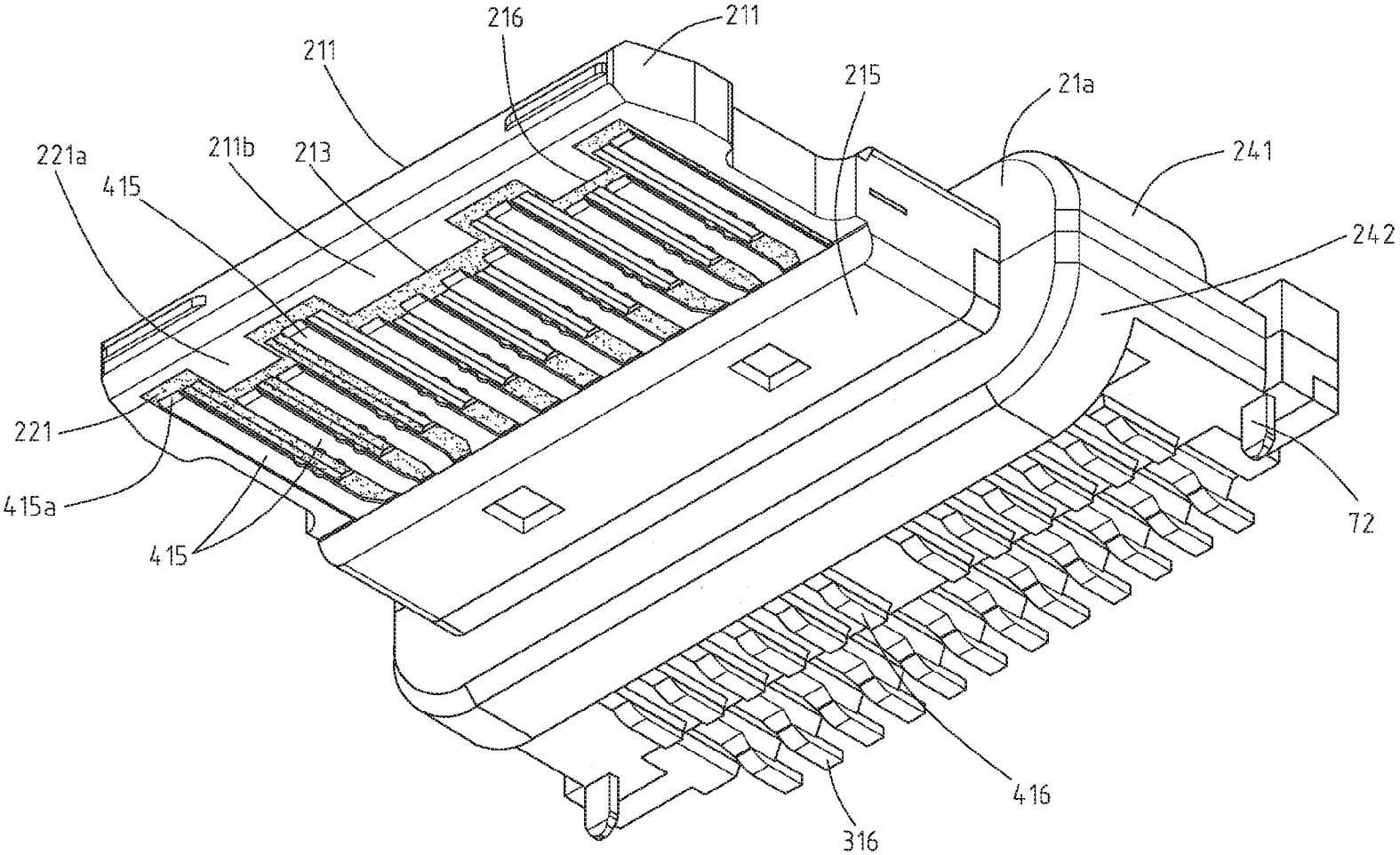
FIG. 9 illustrates a top view of the electrical receptacle connector of the first embodiment.
Figure 10:
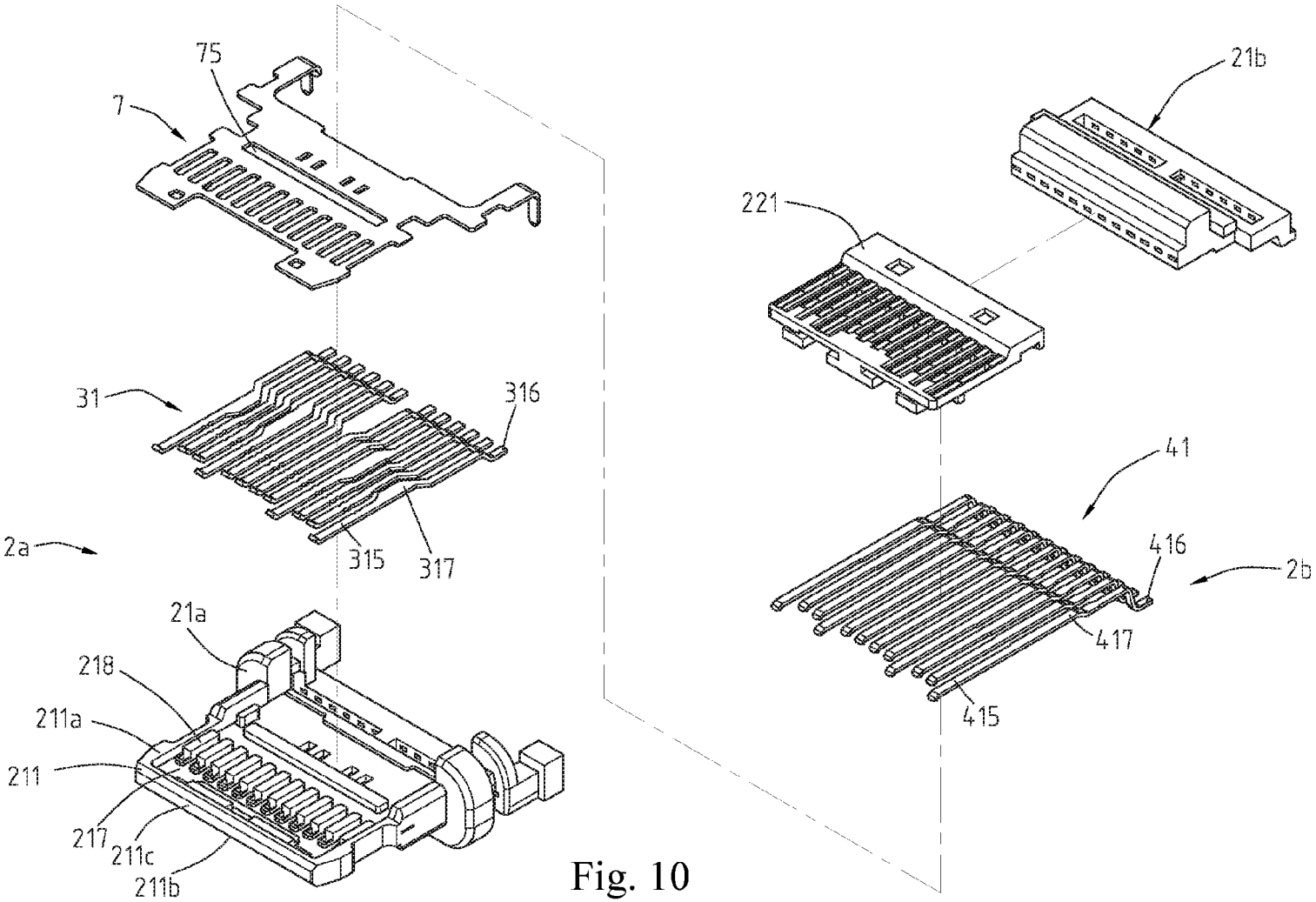
FIG. 10 illustrates an exploded view of an electrical receptacle connector according to a second embodiment of the instant disclosure.
Figure 11:
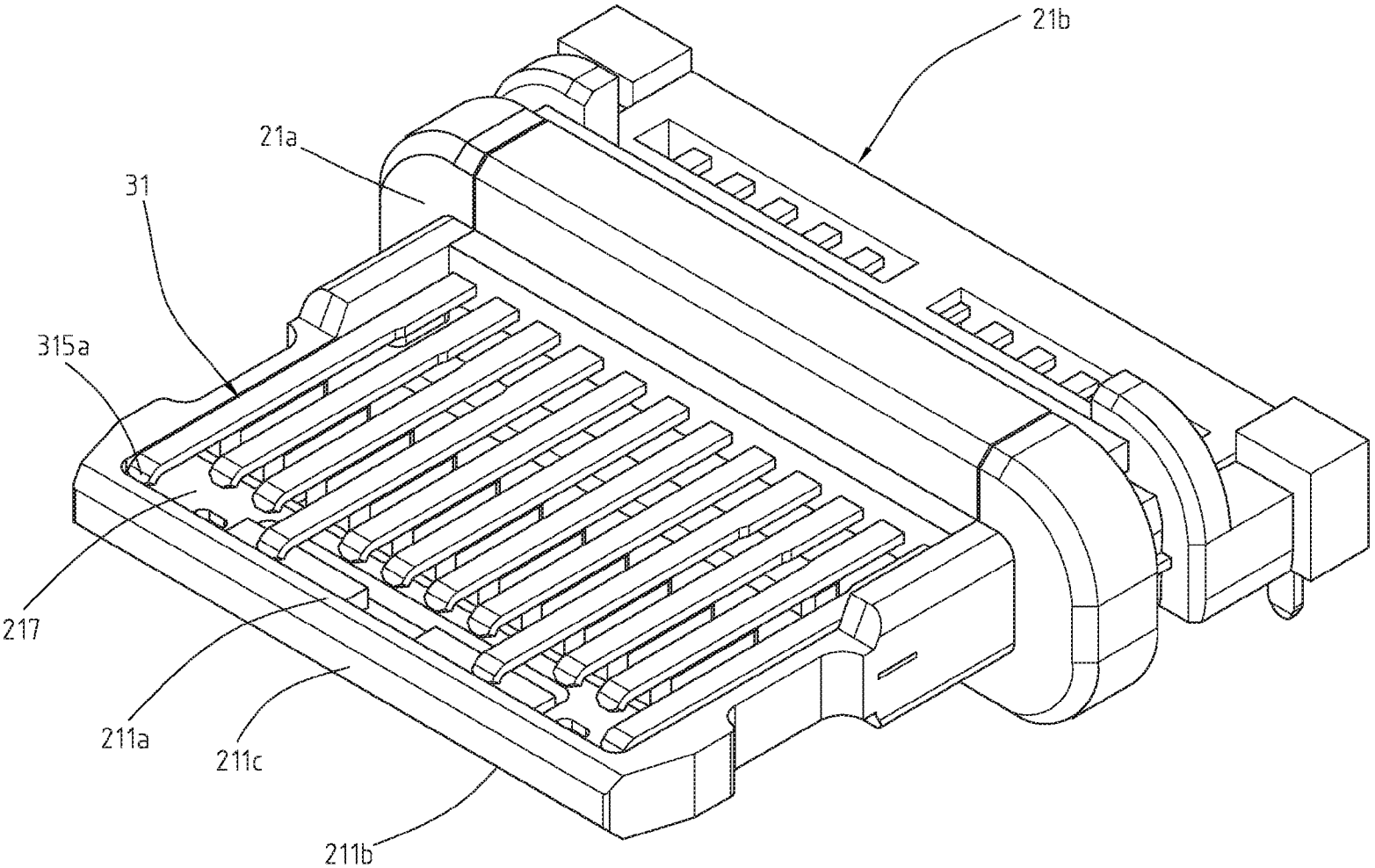
FIG. 11 illustrates a schematic view (1) showing an assembling procedure of the electrical receptacle connector of the second embodiment.

Please refer to FIGS. 1 and 2. In this embodiment, the first terminal module 2*a* is received in the receptacle cavity 112 of the metallic shell 11. The first terminal module 2*a* comprises a first insulated member 21*a* and a plurality of first receptacle terminals 31. The first insulated member 21*a* comprises the tongue portion 211 and a specific portion 213 (as shown in FIG. 9). The tongue portion 211 has two opposite surfaces, one is a first surface 211*a* , and the other is the second surface 211*b*. In addition, a front lateral surface 211*c* of the tongue portion 211 is connected the first surface 211*a* with the second surface 211*b* and is close to the insertion opening 113. In other words, the front lateral surface 211*c* is near to the insertion opening 113 and perpendicularly connected to the first surface 211*a* and the second surface 211*b*, respectively. Specifically, the two surfaces of the tongue portion 211 respectively comprise the specific portion 213 and an assembling surface 224 opposite to the specific portion 213 (as shown in FIGS. 3 and 7). Flat contact portions 315 of the first receptacle terminals 31 are positioned with the assembling surface 214, and front ends of the flat contact portions 315 are held in the assembling surface 214.

Please refer to FIGS. 2, 3, 7, and 9. The first receptacle terminals 31 are on the first insulated member 21*a*. In other word, the first receptacle terminals 31 are on the second terminal module 2*b*, and the first receptacle terminals 31 are integrally formed with the first insulated member 21*a* to form the first terminal module 2*a*. Each of the first receptacle terminals 31 comprises a flat contact portion 315 held on one of two opposite surfaces of the tongue portion 211 (which may be the first surface 211*a* or the second surface 211*b*), and the specific portion 213 is formed on the other surface of the tongue portion 211 (which may be the second surface 211*b* or the first surface 211*a*). The specific portion 213 is a portion for disposing the flat contact portions 415 of the second receptacle terminals 41.

Figure 5:
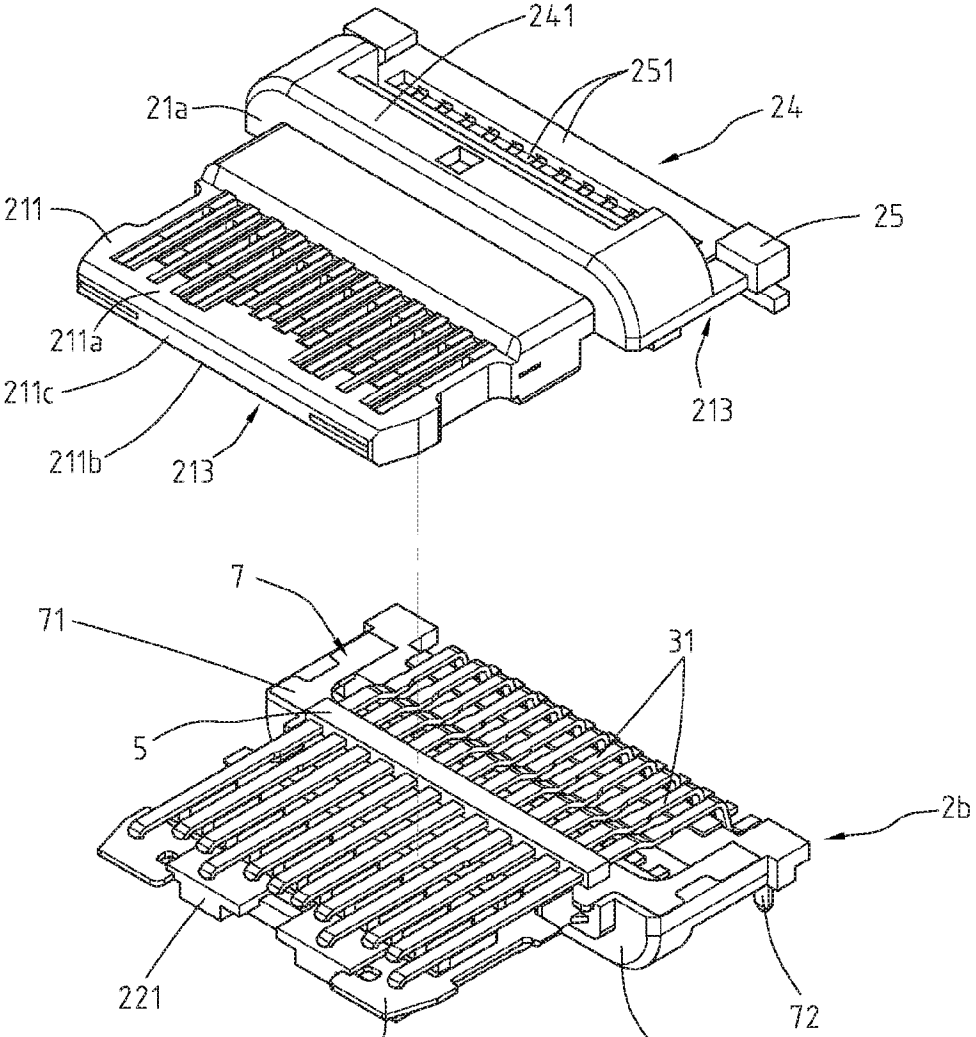
FIG. 5 illustrates a schematic view (2) showing an assembling procedure of the electrical receptacle connector of the first embodiment.
Figure 13:
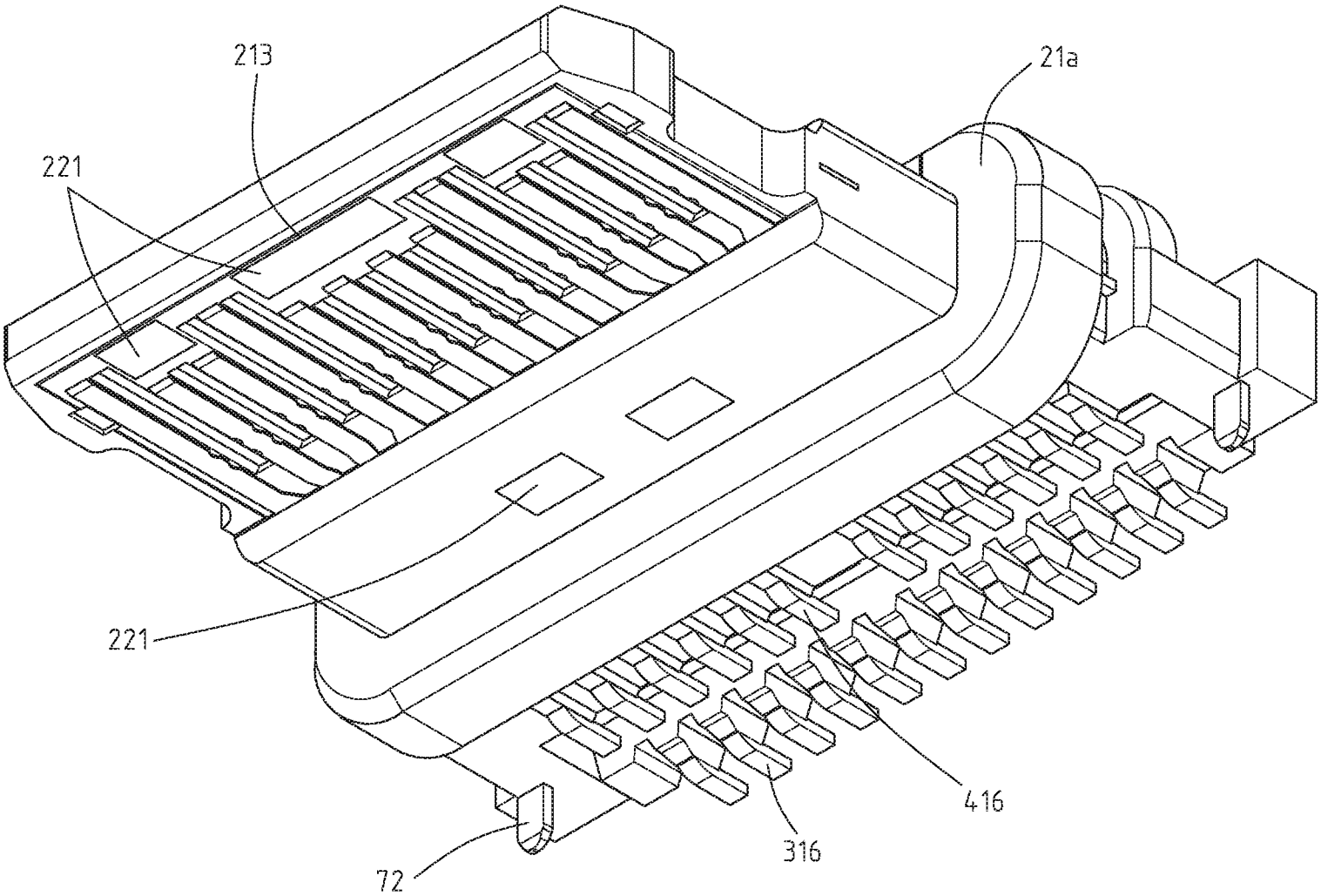
FIG. 13 illustrates a schematic view (3) showing an assembling procedure of the electrical receptacle connector of the second embodiment.

Please refer to FIGS. 2, 5, and 13. The second terminal module 2*b* is received in the receptacle cavity 112 of the metallic shell 11. The first terminal module 2*a* is assembled with the second terminal module 2*b*. The second terminal module 2*b* comprises a second insulated member 21*b* and a plurality of second receptacle terminals 41. The second receptacle terminals 41 are on the second insulated member 21*b*. In other words, the second receptacle terminals 41 and the second insulated member 21*b* are integrally formed with each other. In addition, each of the second receptacle terminals 41 comprises a flat contact portion 415 (as shown in FIG. 3). Moreover, the second insulated member 21*b* comprises a terminal positioning portion 221. The terminal positioning portion 221 is on the specific portion 213. The flat contact portions 415 are on a surface of the terminal positioning portion 221. In other words, the surface of the terminal positioning portion 221 comprises a disposing surface 221*a* , and front ends of the flat contact portions 415 are held in the disposing surface 221*a*. In addition, the terminal positioning portion 221 is held in the tongue portion 211. The disposing surface 221*a*, of the terminal positioning portion 221 and the specific portion 213 of the tongue portion 211 are at the same plane, and the surface texture of the terminal positioning portion 221 is different from the surface texture of the specific portion 213.

Figure 4:
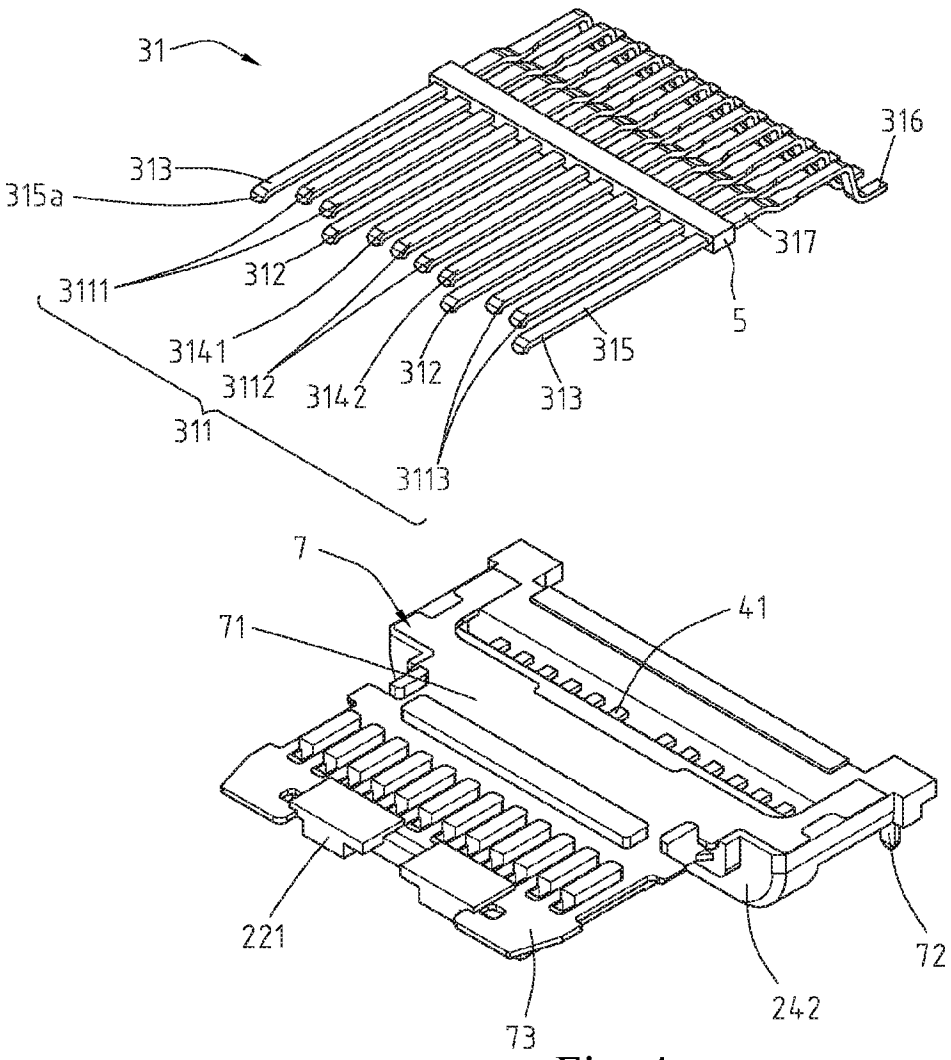
FIG. 4 illustrates a schematic view (1) showing an assembling procedure of the electrical receptacle connector of the first embodiment.
Figure 6:
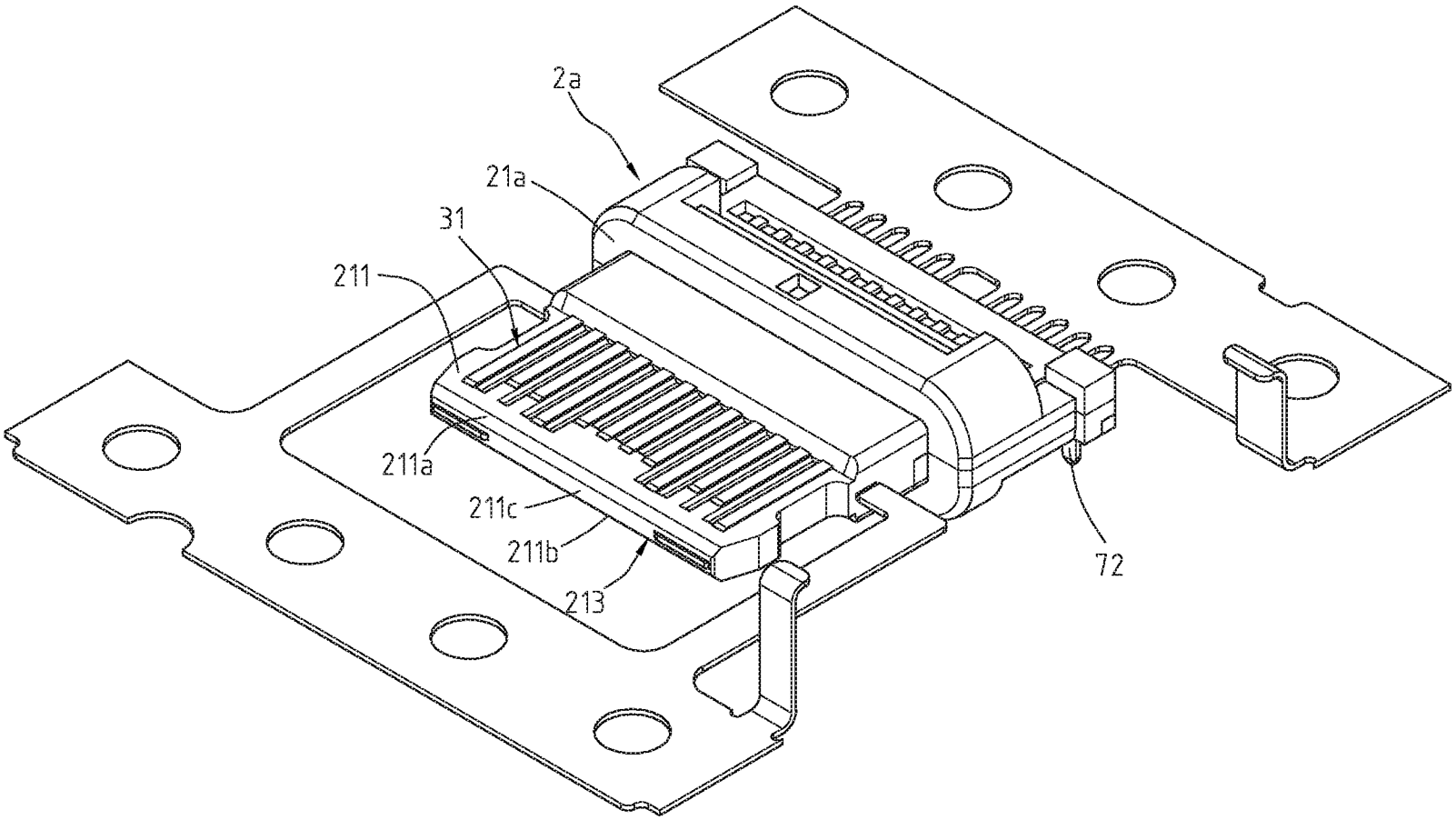
FIG. 6 illustrates a schematic view (3) showing an assembling procedure of the electrical receptacle connector of the first embodiment.

In this embodiment, the terminal positioning portion 221 and the second receptacle terminals 41 are combined with each other in a first processing procedure. Next, the second insulated member 21*b* is assembled with an assembly of the second receptacle terminals 41 and the terminal positioning portion 221 as well as the shielding plate 7 by insert-molding techniques (as shown in FIG. 4). In other words, the second terminal module 2*b* is made firstly. Next, the first receptacle terminals 31 are placed on the terminal positioning portion 221 (as shown in FIGS. 4 and 5). The first receptacle terminals 31 are positioned by a positioning block 5, so that positions of the first receptacle terminals 31 and distances between adjacent first receptacle terminals 31 are fixed. Moreover, the positioning block 5 is enclosed by the first insulated member 21*a*. Then, after the first receptacle terminals 31 are disposed on the second terminal module 2*b*, the first receptacle terminals 31 and the first insulated member 21*a* are integrally formed with each other to form the first terminal module 2*a* (as shown in FIG. 6). In other words, in a second processing procedure, the first insulated member 21*a* is formed in the mold and assembled with the second insulated member 21*b* by insert-molding techniques. Thereafter, the first insulated member 21*a* covers on the second insulated member 21*b* and the material band of the terminals is removed (as shown in FIGS. 6 and 7). The first insulated member 21*a* and the second insulated member 21*b* are integrally formed with each other, so that the first receptacle terminals 31, the second receptacle terminals 41, the first insulated member 21*a*, and the second insulated member 21*b* can be firmly positioned with each other. Therefore, when the connector is impacted by a foreign force, the components of the connector would not detach from each other easily.

Please refer to FIG. 9. In this embodiment, the tongue portion 211 encloses most of the terminal positioning portion 221 and only an exposed surface of the terminal positioning portion 221 is exposed from the tongue portion 211. In addition, the exposed surface of the terminal positioning portion 221 and the other surface of the tongue portion 211 are at the same horizontal plane. In other words, the terminal positioning portion 221 is approximately at the middle portion of the tongue portion 211. Moreover, the surface texture of the exposed surface of the terminal positioning portion 221 and the surface texture of the second surface 211*b* of the tongue portion 211 are different from each other (as shown in FIG. 9, portions at the middle portion of the tongue portion 211 with spots filled therein indicate the terminal positioning portion 221).

The terminal positioning portion 221 and the tongue portion 211 are formed in different insert-molding procedures, therefore the surface texture of the exposed surface of the terminal positioning portion 221 is different from the surface texture of the second surface 211*b* of the tongue portion 211. In other words, the surface structures between the two surfaces are different. Accordingly, when the surface structures between two surfaces are different, two components respectively having the two surfaces may be formed in different time durations. In this embodiment, the exposed surface of the terminal positioning portion 221 is rough, and the other surface of the tongue portion 211 is smooth, but embodiments are not limited thereto. Alternatively, the exposed surface of the terminal positioning portion 221 may be smooth, and the other surface of the tongue portion 211 may be rough.

Please refer to FIG. 9. In this embodiment, the specific portion 213 of the tongue portion 211 comprises a separating portion 216 surrounding a periphery of the terminal positioning portion 211. When the terminal positioning portion 221 is insert-molded with the tongue portion 211, the separating portion 216 is a trace indicating that the tongue portion 211 and the terminal positioning portion 221 are processed. Therefore, it can be understood that the tongue portion 211 and the terminal positioning portion 221 are formed by different processing procedures.

Please refer to FIGS. 2, 5, and 6. In this embodiment, the first insulated member 21*a* comprises a first base 241, and the tongue portion 211 is extending from one end of the first base 241. The second insulated member 21*b* comprises a second base 242, and the terminal positioning portion 221 is extending from one end of the second base 242. The first base 241 is formed on the second base 242. The tongue portion 211 is a piece for mating with an electrical plug connector, while the terminal positioning member 252 is a semi-product structure held in the tongue portion 211. In addition, in this embodiment, the first insulated member 21*a* comprises the tongue portion 211, but embodiments are not limited thereto. In some embodiments, the tongue portion 211 may be extending from the second base 242. In other words, the second insulated member 21*b* comprises the tongue portion 211, and the first insulated member 21*a* excludes the tongue portion 211.

Please refer to FIG. 9. In this embodiment, the surface texture of the first base 241 is different from the surface texture of the second base 242. Since the terminal positioning portion 221 and the tongue portion 211 are formed in different insert-molding procedures, the surface textures of the two surfaces are different. Accordingly, when the surface structures between two surfaces are different, two components individually having the two surfaces may be formed in different time durations (as shown in FIG. 9, the second base 242 is indicated by portions filled with spots).

Please refer to FIG. 9. In this embodiment, the first insulated member 21*a* comprises a thicken block 215 on a rear portion of the tongue portion 211 and near to the first base 241 and the second base 242. The thicken block 215 covers a portion between the terminal positioning portion 221 and the second base 242. Accordingly, the structural strength of the tongue portion 211 can be improved by the thicken block 215.

Please refer to FIG. 2. In this embodiment, the electrical receptacle connector 100 further comprises a first conductive sheet 61 and a second conductive sheet 62 symmetrical with each other. From a front view of each of the conductive sheets 61, 62, each of the conductive sheets 61, 62 is an elongated sheet having widened U-shaped cross section, and the structure of the first conductive sheet 61 is the same as that of the second conductive sheet 62. The first conductive sheet 61 and the second conductive sheet 62 are respectively on the first insulated member 21*a* and the second insulated member 21*b*. The first conductive sheet 61 has two first contact legs 611 at two sides thereof. The two first contact legs 611 pass through two first through holes 2191 of the first insulated member 21*a* and are in contact with two ground terminals 313 which are at two sides of the first receptacle terminals 31, respectively. Conversely, the second conductive sheet 62 has two second contact legs 621 at two sides thereof. The two second contact legs 621 passes through two second through holes 2192 of the second insulated member 21*b* and are in contact with two ground terminals 413 which are at two sides of the second receptacle terminals 41. Therefore, the first conductive sheet 61 and the second conductive sheet 62 are respectively in contact with and conducted with the ground terminals 313 of the first receptacle terminals 31 and the ground terminals 413 of the second receptacle terminals 41. The first conductive sheet 61 and the second conductive sheet 62 are respectively in contact with the metallic shell 11. Therefore, when the electrical receptacle connector 100 is mated with an electrical plug connector, a metallic shell of the electrical plug connector is in contact with the first conductive sheet 61 and the second conductive sheet 62, so that the metallic shell of the electrical plug connector and the metallic shell 11 of the electrical receptacle connector 100 can be connected with each other. Accordingly, the connection between the shells of the connectors can be grounded and the electromagnetic interference (EMI) during the signal transmission can be reduced by the first conductive sheet 61 and the second conductive sheet 61.

Please refer to FIGS. 2, 3, and 8. The first receptacle terminals 31 comprise a plurality of first signal terminals 311, power terminals 312, and ground terminals 313. The first signal terminals 31 comprises a plurality of pairs of first high-speed signal terminals 3111/3113 and a pair of first low-speed signal terminals 3112. Referring to FIG. 7, the first receptacle terminals 31 comprise, from left to right, a ground terminal 313 (Gnd), a first pair of first high-speed signal terminals 3111 (TX1+−, differential signal terminals for high-speed signal transmission), a power terminal 312 (Power/VBUS), a first function detection terminal 3141 (CC1, a terminal for inserting orientation detection of the connector and for cable recognition), a pair of first low-speed signal terminals 3112 (D+−, differential signal terminals for low-speed signal transmission), a supplement terminal 3142 (SUCH, a terminal can be reserved for other purposes), another power terminal 312 (Power/VBUS), a second pair of first high-speed signal terminals 3113 (RX2+−, differential signal terminals for high-speed signal transmission), and another ground terminal 313 (Gnd). In this embodiment, twelve first receptacle terminals 31 are provided for transmitting US 3.0 signals. Each pair of the first high-speed signal terminals 3111/3113 is between the corresponding power terminal 312 and the adjacent ground terminal 313. The pair of the first low-speed signal terminals 3112 is between the first function detection terminal 3141 and the supplement terminal 3142.

In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 3, 4, and 9. The first receptacle terminals 31 are held in the first insulated member 21*a* and formed as the upper-row terminals of the electrical receptacle connector 100. Each of the first receptacle terminals 31 comprises a flat contact portion 315, a body portion 317, and a tail portion 316. For each of the first receptacle terminals 31, the body portion 317 is held in the first insulated member 21*a*, the flat contact portion 315 is extending forward from the body portion 317 in the rear-to-front direction and partly exposed upon the first surface 211*a* of the tongue portion 211, and the tail portion 316 is extending backward from the body portion 317 in the front-to-rear direction and protruding from the rear of the first insulated member 21*a*.The first signal terminals 311 are disposed on the first surface 211*a* and transmit first signals (namely, US 3.0 signals). The tail portions 316 are bent horizontally to form flat legs, named legs manufactured by SMT (surface mounted technology), which can be mounted or soldered on the surface of a printed circuit board by using surface mount technology. Alternatively, the tail portions 316 may be extending downwardly to form vertical legs, named legs manufactured by through-hie technology, which can be inserted into holes drilled in a printed circuit board (PCB). In addition, the overall width of the tail portions 316 is equal to the overall width of the body portions 317. Therefore, the tail portion 316 and the body portion 317 of each of the first receptacle terminals 31 are aligned along the same line, and the distance between two adjacent tail portions 316 correspond the distance between two adjacent contacts of the circuit board 8.

Please refer to FIGS. 3, 8, and 9. The second receptacle terminals 41 comprise a plurality of second signal terminals 411, power terminals 412, and ground terminals 413. The second receptacle terminals 41 comprise a plurality of pairs of second high-speed signal terminals 4111/4113 and a pair of second low-speed signal terminals 4112. Referring to FIG. 7, the second receptacle terminals 41 comprise, from right to left, a ground terminal 413 (Gnd), a first pair of second high-speed signal terminals 4111 (TX2+−, differential signal terminals for high-speed signal transmission), a power terminal 412 (Power/VBUS), a second function detection terminal 4141 (CC2, a terminal for inserting orientation detection of the connector and for cable recognition), a pair of second low-speed signal terminals 4112 (D+−, differential signal terminals for low-speed signal transmission), a supplement terminal 4142 (SBU2, a terminal can be reserved for other purposes), another power terminals 412 (Power/VBUS), a second pair of second high-speed signal terminals 4113 (RX1+−, differential signal terminals for high-speed signal transmission), and another ground terminal 413 (Gnd). In this embodiment, twelve second receptacle terminals 41 are provided for transmitting US 3.0 signals. Each pair of the second high-speed signal terminals 4111/4113 is between the corresponding power terminal 412 and the adjacent ground terminal 413. The pair of the second low-speed signal terminals 4112 is between the second function detection terminal 4141 and the supplement terminal 4142.

In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 3, 4, 8, and 9. The second receptacle terminals 41 are held in the second insulated member 21*b* and formed as the lower-row terminals of the electrical receptacle connector 100. In addition, the first receptacle terminals 31 are substantially aligned parallel with the second receptacle terminals 41. In this embodiment, each of the second receptacle terminals 41 comprises a flat contact portion 415, a body portion 417, and a tail portion 416. For each of the second receptacle terminals 41, the body portion 417 is held in the second insulated member 21*b* and the tongue portion 211, the flat contact portion 415 is extending from the body portion 417 in the rear-to-front direction and partly exposed upon the second surface 211*b* of the tongue portion 211, and the tail portion 416 is extending backward from the body portion 417 in the front-to-rear direction and protruding from the rear of the second insulated member 21*b*. The second signal terminals 411 are disposed at the second surface 211*b* and transmit second signals (i.e., US 3.0 signals). The tail portions 416 are bent horizontally to form flat legs, named legs manufactured by SMUT (surface mounted technology), which can be mounted or soldered on the surface of a printed circuit board by using surface mount technology. Alternatively, the tail portions 416 may be extending downwardly to form vertical legs, named legs manufactured by through-hole technology, which can be inserted into holes drilled in a printed circuit board (PCB). The tail portions 316 of the first receptacle terminals 31 and the tail portions 416 of the second receptacle terminals 41 are arranged in a staggered manner from the top view.

Please refer to FIGS. 3 and 7. In this embodiment, each of the first receptacle terminals 31 comprises a first engaging portion 315*a* extending from a front portion of the corresponding flat contact portion 315 to form a hook structure. For the same first receptacle terminal 31, the first engaging portion 315*a* is opposite to the tail portion 316. Additionally, after the first insulated member 21*a* is formed, the first engaging portions 315*a* of the first receptacle terminals 31 are engaged into the tongue portion 211. Accordingly, the flat contact portions 315 can be positioned on the first surface 211*a* of the tongue portion 211 firmly. Hence, the flat contact portions 315 of the electrical receptacle connector 100 would not detach off the first surface 211*a* of the tongue portion 211 after the connector is used for a period.

Please refer to FIGS. 3 and 9. In this embodiment, each of the second receptacle terminals 41 comprises a second engaging portion 415*a* extending from a front portion of the corresponding flat contact portion 415 to form a hook structure. For the same second receptacle terminal 41, the second engaging portion 415*a* is opposite to the tail portion 416. Additionally, after the second insulated member 21*b* is formed, the second engaging portions 415*a* of the second receptacle terminals 41 are engaged into the terminal positioning portion 221. Accordingly, the flat contact portions 415 can be positioned on the exposed surface of the terminal positioning portion 221 firmly. Hence, the flat contact portions 415 of the electrical receptacle connector 100 would not detach off the terminal positioning portion 221 after the connector is used for a period.

Please refer to FIGS. 2 and 4. The electrical receptacle connector 100 comprises a shielding plate 7 between the first terminal module 2*a* and the second terminal module 2*b*. The shielding plate 7 comprises a plate body 71 and a plurality of legs 72. The plate body 71 is between the flat contact portions 315 of the first receptacle terminals 31 and the flat contact portions 415 of the second receptacle terminals 41. In other words, the plate body 71 is integrally formed with the second insulated member 21*b* and between the flat contact portions 315, 415, so that the plate body 71 is assembled on the surface of the second insulated member 21*b*. Specifically, the plate body 71 may be lengthened and widened, so that the front of the plate body 71 is near to the front lateral surface 211*c* of the tongue portion 211 (as shown in FIGS. 5 and 6). Two sides of the plate body 71 is protruding from two sides of the tongue portion 211 for being in contact with an electrical plug connector, and the rear of the plate body 71 is near to the rear of the second insulated member 22. Accordingly, the plate body 71 can be disposed on the tongue portion 211 and the second insulated member 21*b*, and the structural strength of the tongue portion 211 and the shielding performance of the tongue portion 211 can be improved.

In addition, the legs 72 are extending from the rear portion of the shielding plate 7 to form vertical legs. That is, the legs 72 are exposed from the second insulated member 21*b* and in contact with the circuit board 8. In this embodiment, the crosstalk interference can be reduced by the shielding of the shielding plate 7 when the flat contact portions 315, 415 transmit signals. Furthermore, the structural strength of the tongue portion 211 can be improved by the assembly of the shielding plate 7. In addition, the legs 72 of the shielding plate 7 are exposed from the second insulated member 21*b* and in contact with the circuit board 8 for conduction and grounding.

Please refer to FIG. 4. The shielding plate 7 further comprises a plurality of hooks 73. The hooks 73 are extending outward from two sides of the front portion of the plate body 71 and protruding out of the front lateral surface 211*c* and two sides of the tongue portion 211. When an electrical plug connector is mated with the electrical receptacle connector 100, elastic pieces at two sides of an insulated housing of the electrical plug connector are engaged with the hooks 73, and the elastic pieces would not wear against the tongue portion 211 of the electrical receptacle connector 100. Hence, the shielding plate 7 can be in contact with the metallic shell 11 for conduction and grounding.

Please refer to FIGS. 1, 2, and 8. In this embodiment, the first receptacle terminals 31 and the second receptacle terminals 41 are disposed upon the first surface 211*a* and the second surface 211*b* of the tongue portion 211, respectively, and pin-assignments of the first receptacle terminals 31 and the second receptacle terminals 41 are point-symmetrical with a central point of the receptacle cavity 112 as the symmetrical center. In other words, pin-assignments of the first receptacle terminals 31 and the second receptacle terminals 41 have 180-degree symmetrical design with respect to the central point of the receptacle cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 211*a* is facing up, for transmitting first signals. Conversely, the electrical plug connector is inserted into the electrical receptacle connector 100 with a second orientation where the first surface 211*a* is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Please refer to FIG. 1 and FIGS. 2 to 8. In this embodiment, as viewed from the front of the receptacle terminals 31, 41, the position of the first receptacle terminals 31 corresponds to the position of the second receptacle terminals 41. In other words, the positions of the flat contact portions 315 are respectively aligned with the positions of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. Accordingly, because of the offset alignment of the flat contact portions 315, 415, the crosstalk between the first receptacle terminals 31 and the second receptacle terminals 41 can be reduced during signal transmission. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting US 3.0 signals, but embodiments are not limited thereto. In some embodiments, for the first receptacle terminals 31 in accordance with transmission of US 2.0 signals, the first pair of the first high-speed signal terminals 3111 (TX1+−) and the second pair of the first high-speed signal terminals 3113 (RX2+−) are omitted, and the pair of the first low-speed signal terminals 3112 (D+−) and the power terminals 312 (Power/VBUS) are retained. While for the second receptacle terminals 41 in accordance with transmission of US 2.0 signals, the first pair of the second high-speed signal terminals 4111 (TX2+−) and the second pair of the second high-speed signal terminals 4113 (RX1+−) are omitted, and the pair of the second low-speed signal terminals 4112 (D+−) and the power terminals 412 (Power/VBUS) are retained.

Please refer to FIGS. 2 and 7. In this embodiment, the first terminal module 2*a* further comprises a rear block member 25 and two through grooves 251. The rear block member 25 is extending outward from the rear portion of the first insulated member 21*a*. In this embodiment, the rear block member 25 covers rear portions of the tail portions 416 of the second receptacle terminals 41. The two through grooves 251 are formed on the middle portion of the rear block member 25 and corresponding to the positions of the tail portions 416. Accordingly, a user can check the soldering condition between the tail portions 416 and the circuit board 8 through the through grooves 251. In this embodiment, the number of the through grooves 251 is two, but embodiments are not limited thereto. Alternatively, the first terminal module 2*a* may comprise one through groove 251; in a further option, the first terminal module 2*a* may comprise three or more through grooves 251.

Figure 12:
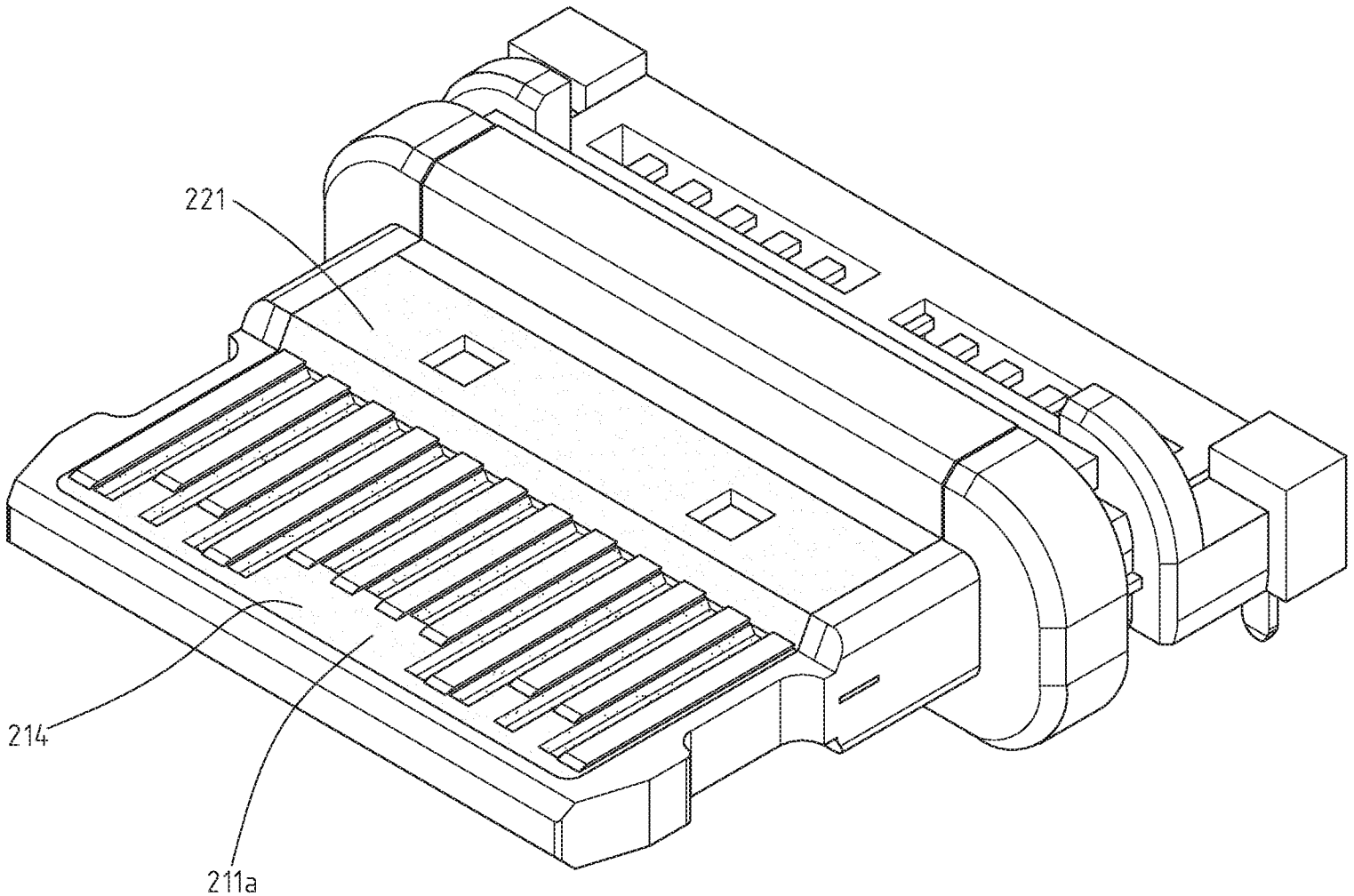
FIG. 12 illustrates a schematic view (2) showing an assembling procedure of the electrical receptacle connector of the second embodiment.

FIGS. 10 to 13 illustrate an electrical receptacle connector 100 according to a second embodiment of the instant disclosure. The processing procedures of the first insulated member 21*a* and the second insulated member 21*b* in the second embodiment are different from that in the first embodiment. In addition, textures of surfaces of the connector of the first embodiment is different from that of the second embodiment. In this embodiment, the first insulated member 21*a* further comprises a second specific portion (namely, the assembling surface 214) formed on a surface of the tongue portion 211 and connecting to the specific portion 213. The other surface of the terminal positioning portion 221 and the surface of the tongue portion 211 are at the same horizontal plane. In addition, the surface texture of other surface of the terminal positioning portion 221 is different from the surface texture of the surface of the tongue portion 211 (as shown in FIGS. 12 and 13, the terminal positioning portion 221 is indicated by portions filled with spots).

Please refer to FIGS. 10 to 13. In this embodiment, the first terminals module 2*a* having the tongue portion 211 is formed in a first processing procedure; that is, the first insulated member 21*a*, the first receptacle terminals 31 (lower terminals), and the shielding plate 7 are formed with each other by insert-molding techniques. The flat contact portions 315 are on the other surface of the tongue portion 211. Next, the first insulated member 21*a* is recessed to form a filling groove 217 and a plurality of protrusions 218. A front portion of the filling groove 217 is recessed on the surface of the tongue portion 211, and the protrusions 218 are aligned in the filling groove 217 along a transversal direction. Each of the protrusions 218 corresponds to the corresponding flat contact portion 415. Therefore, the flat contact portions 415 are leaned against the protrusions 218, positioned with the protrusions 218, and not moved freely. The protrusions 218 may be applied on the terminal positioning portion 221 in the first embodiment for being leaned against the flat contact portions 415 (as shown in FIG. 2).

It is understood that, in this embodiment, the second terminal module 2*b* is formed in a second processing procedure; that is, the second insulated member 21*b* and the second receptacle terminals 41 (upper terminals) are formed with each other by insert-molding techniques. The second insulated member 21*b* is at the rear portion of the flat contact portions 415. The second insulated member 21*b* is assembled on the rear portion of the filling groove 217, so that the flat contact portions 415 can be positioned on the protrusions 218. Next, glues in liquid state can be poured into the filling groove 217, so that two sides of each of the flat contact portions 415 are enclosed by the glues and only the surface of each of the flat contact portions 415 is exposed. In detail, the glues in liquid state are poured into the filling groove 217 from the surface of the tongue portion 211 (i.e., the first surface 211*a*) and pass through the hole 75 of the shielding plate 7 to be distributed over the other surface of the tongue portion 211 (i.e., the second surface 211*b*). After the glues are dried and set to form a solid terminal positioning portion 221, the terminal positioning portion 221 can be firmly positioned and fixed with the first receptacle terminals 31, the second receptacle terminals 41, the first insulated member 21*a*, the second insulated member 21*b*, and the shielding plate 7. Therefore, when the connector is impacted by a foreign force, the components of the connector would not detach from each other easily.

Specifically, in this embodiment, the surface texture of the other surface of the terminal positioning portion 221 is different from the surface of the tongue portion 211 (i.e., the first surface 211*a*), just opposite to the case described in the first embodiment; namely, in the first embodiment, the surface texture of the surface of the terminal positioning portion 221 is different from the other surface of the tongue portion 211. In detail, because the terminal positioning portion 221 is held in the tongue portion 211, in this embodiment, the surface difference between the terminal positioning portion 221 and the surface of the tongue portion 211 (i.e., the first surface 211*a*) can be directly checked from the surface of the tongue portion 211 (the first surface 211*a*); while in the first embodiment, the surface difference between the terminal positioning portion 221 and the other surface of the tongue portion 211 (i.e., the second surface 211*b*) can be directly checked from the other surface of the tongue portion 211.

Moreover, in this embodiment, the surface of the tongue portion 211 (i.e., the first surface 211*a*) communicates with the other surface of the tongue portion 211 (i.e., the second surface 211*b*) through the filling groove 217. That is, the specific portion 213 on the other surface of the tongue portion (i.e., the second surface 211*b*) communicates with the second specific portion (namely, the assembling surface 214) of the surface of the tongue portion 211 (i.e., the first surface 211*a*). After the terminal positioning portion 221 is formed, the other surface of the terminal positioning portion 221 and the surface of the tongue portion 211 (i.e., the first surface 211*a*) are at the same horizontal plate. As above, the two surface of the tongue portion 211 (i.e., the first surface 211*a* and the second surface 211*b*) have different surface textures and the two surfaces of the terminal positioning portion 221 have different surface textures. Accordingly, when the surface structures between two surfaces are different, two components individually having the two surfaces may be formed in different time durations. In this embodiment, the surface of the terminal positioning portion 221 is rough, and the other surface of the tongue portion 211 is smooth, but embodiments are not limited thereto. Alternatively, the surface of the terminal positioning portion 221 may be smooth, and the other surface of the tongue portion 211 may be rough.

Based on the above, after the second insulated member is formed, the first receptacle terminals are disposed on the second insulated member. Next, the terminal positioning portion is assembled with the second insulated member by molding or glue pouring. The terminal positioning portion is further positioned with the first receptacle terminals. Therefore, the first insulated member and the second insulated member are integrally formed with each other. Accordingly, the first receptacle terminals, the second receptacle terminals, the first insulated member, and the second insulated member are firmly positioned with each other. Hence, when the connector is impacted by a foreign force, the components of the connector would not detach from each other easily. Moreover, after the assembling procedure, the surface of the terminal positioning portion and the surface of the tongue portion are different in texture for indicating different forming procedures. Additionally, the first and the second engaging portions of the first and the second receptacle terminals are engaged into the tongue portion and the terminal positioning portion, respectively. Accordingly, the flat contact portions of the electrical receptacle connector would not detach off the tongue portion and the terminal positioning portion after the connector is used for a period.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. An either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a second terminal module comprising a plurality of second receptacle terminals and a second insulated member integrally formed with the second receptacle terminals, wherein each of the second receptacle terminals comprises a second flat contact portion, the second insulated member has a terminal positioning portion positioned with the second flat contact portions, the terminal positioning portion comprises a disposing surface, front ends of the second flat contact portions are held in the disposing surface;

a plurality of first receptacle terminals on the second terminal module, wherein the first receptacle terminals are integrally formed with a first insulated member to form a first terminal module, the first insulated member comprises a tongue portion, one of two opposite surfaces of the tongue portion comprises an assembling surface, the other surface of the tongue portion comprises a specific portion opposite to the assembling surface, first flat contact portions of the first receptacle terminals are positioned with the assembling surface, and front ends of the first flat contact portions are held in the assembling surface, the terminal positioning portion is held in the tongue portion, the disposing surface of the terminal positioning portion and the specific portion of the tongue portion are at a same plane, and a surface texture of the terminal positioning portion is different from a surface texture of the specific portion; and a metallic shell comprising a receptacle cavity for receiving the first terminal module and the second terminal module.

2. The electrical receptacle connector according to claim 1, wherein the first receptacle terminals are positioned by a positioning block, so that positions of the first receptacle terminals and distances between adjacent first receptacle terminals are fixed, and wherein the positioning block is enclosed by the first insulated member.

3. The electrical receptacle connector according to claim 1, wherein each of the first receptacle terminals comprises a first engaging portion extending from a front portion of the corresponding first flat contact portion and engaged into the tongue portion.

4. The electrical receptacle connector according to claim 1, wherein each of the second receptacle terminals comprises a second engaging portion extending from a front portion of the corresponding second flat contact portion and engaged into the terminal positioning portion.

5. The electrical receptacle connector according to claim 1, wherein the first insulated member comprises a first base, the tongue portion is extending from one end of the first base, the second insulated member comprises a second base, the terminal positioning portion is extending from one end of the second base, the first base is integrally formed on the second base.

6. The electrical receptacle connector according to claim 5, wherein a surface texture of the first base is different from a surface texture of the second base.

7. The electrical receptacle connector according to claim 5, wherein each of the first receptacle terminals further comprises a first tail portion extending, from the corresponding first flat contact portion, out of a bottom of the first base, each of the second receptacle terminals further comprises a second tail portion extending, from the corresponding second flat contact portion, out of a bottom of the second base, the first tail portions are aligned with the second tail portions in a staggered manner from a top view thereof.

8. The electrical receptacle connector according to claim 5, wherein the first insulated member comprises a thicken block on a rear portion of the tongue portion and near to the first base and the second base, the thicken block covers a portion between the terminal positioning portion and the second base.

9. The electrical receptacle connector according to claim 5, further comprising a first conductive sheet and a second conductive sheet respectively on the first insulated member and the second insulated member.

10. The electrical receptacle connector according to claim 9, wherein the first conductive sheet has two first contact legs at two sides thereof, the two first contact legs pass through two first through holes of the first insulated member and are in contact with two first ground terminals which are at two sides of the first receptacle terminals, respectively.

11. The electrical receptacle connector according to claim 9, wherein the second conductive sheet has two second contact legs at two sides thereof, the two second contact legs pass through two second through holes of the second insulated member and are in contact with two second ground terminals which are at two sides of the second receptacle terminals, respectively.

12. The electrical receptacle connector according to claim 1, wherein the specific portion of the tongue portion comprises a separating portion formed around a periphery of the terminal positioning portion.

13. The electrical receptacle connector according to claim 1, further comprising a shielding plate integrally formed with the second insulated member and between the first receptacle terminals and the second receptacle terminals.

14. An electrical receptacle connector, comprising:

a base portion, one end thereof extending a tongue portion to form an insulated housing, wherein one of two opposite surfaces of the tongue portion comprises an assembling surface, and the other surface of the tongue portion comprises a specific portion opposite to the assembling surface, the specific portion comprises a terminal positioning portion, a surface texture of the terminal positioning portion is different from a surface texture of the specific portion;

a plurality of first receptacle terminals each comprising a first flat contact portion and a first tail portion extending from the first flat contact portion, wherein the first flat contact portions are formed and positioned with the assembling surface, and front ends of the first flat contact portions are held in the assembling surface, the first tail portions are formed with the base portion;

a plurality of second receptacle terminals each comprising a second flat contact portion and a second tail portion extending from the second flat contact portion, wherein the second flat contact portions are formed and positioned with the terminal positioning portion, and front ends of the second flat contact portions are held in the terminal positioning portion, the second tail portions are formed with the base portion;

a shielding plate in the base portion and the tongue portion, wherein the shielding plate is between the first receptacle terminals and the second receptacle terminals; and a metallic shell comprising a receptacle cavity for receiving the base portion and the tongue portion.

15. The electrical receptacle connector according to claim 14, further comprising a first conductive sheet and a second conductive sheet respectively on two surfaces of the insulated housing.

16. The electrical receptacle connector according to claim 15, wherein the first conductive sheet has two first contact legs at two sides thereof, the two first contact legs pass through two first through holes of the insulated housing and are in contact with two first ground terminals which are at two sides of the first receptacle terminals, respectively.

17. The electrical receptacle connector according to claim 15, wherein the second conductive sheet has two second contact legs at two sides thereof, the two second contact legs pass through two second through holes of the insulated housing and are in contact with two second ground terminals which are at two sides of the second receptacle terminals, respectively.

18. The electrical receptacle connector according to claim 14, wherein each of the first receptacle terminals comprises a first engaging portion extending from a front portion of the corresponding first flat contact portion and engaged into the tongue portion.

19. The electrical receptacle connector according to claim 14, wherein each of the second receptacle terminals comprises a second engaging portion extending from a front portion of the corresponding second flat contact portion and engaged into the terminal positioning portion.

* * * * *